United States Patent [19]

Salit et al.

[11] Patent Number: 4,774,396

[45] Date of Patent: Sep. 27, 1988

[54] INFRARED GENERATOR

[75] Inventors: Herbert W. Salit, Brookline, Mass.; Ralph S. Keen, Jr., Greensboro, N.C.; Robert M. Koeller, Palm Bay, Fla.

[73] Assignee: FabAid Incorporated, Brookline, Mass.

[21] Appl. No.: 37,947

[22] Filed: Apr. 13, 1987

[51] Int. Cl.[4] ..... H05B 3/10

[52] U.S. Cl. ..... 219/553; 219/552; 338/316

[58] Field of Search ..... 219/553, 449, 536, 552, 219/316; 338/317, 303

[56] References Cited

U.S. PATENT DOCUMENTS

| | | | |
|---|---|---|---|
| 3,841,920 | 10/1974 | Martin | 338/303 X |
| 4,620,086 | 10/1986 | Ades et al. | 219/552 |
| 4,652,727 | 3/1987 | Hoshizaki et al. | 219/553 |

*Primary Examiner*—Clifford C. Shaw
*Assistant Examiner*—M. M. Lateef
*Attorney, Agent, or Firm*—John P. McGonagle

[57] ABSTRACT

An apparatus for generating infrared radiation is provided including an electrical heating element that is able to withstand very high, continuous-use temperatures, surrounding or surrounded by a non-conductive material containing dopants of refractory metal oxides, rare earth oxides, or combinations of both. The material may be shaped about the heating element so that the infrared radiation emissions may be focused and/or directed in a desired manner.

24 Claims, 4 Drawing Sheets

INFRARED GENERATOR

BACKGROUND OF THE INVENTION

This invention relates to infrared radiation sources, and more particularly, to a new and improved type of infrared generator.

The transfer of heat at high temperatures is much more effective and efficient by radiation than by conduction and convection. Transfer of heat by radiation takes place by the fourth power of the differences in temperature, and is expressed by the familiar Stefan-Boltzman equation:

$$Q=AK(T_1^4-T_2^4)$$

where:
Q=heat transferred in thermal units/hour;
$T_1$=high level temperature;
$T_2$=low level temperature;
A=area of heat transfer surface; and
K=an appropriate coefficient.

Transfer of heat by conduction and convection, on the other hand, takes place only by the first power difference of the temperature, and is expressed by the equation:

$$Q=AC(t_1-t_2)$$

where:
$t_1$=high level temperature;
$t_2$=low level temperature; and
C=an appropriate coefficient.

Electromagnetic radiation generates heat in any absorbing object lying in its path by causing vibrations or rotations within the atomic structure of the object. Infrared radiation is commonly thought of when transfer of heat by radiation is considered. However, objects placed at the focal point of a lens in a high-density beam of visible light or close to the source of a high-intensity microwave beam, also become heated by a similar process.

The frequency band of infrared radiation ranges from approximately 1 million to 500 million megahertz. This lies between the higher frequency region of visible light and the lower frequency region of microwaves. In terms of wavelength, the infrared spectrum lies between 0.72 and approximately 1,000 microns, that is, between the borders of visible light at the shorter wavelength end and of microwaves at the longer wavelength end of the infrared spectrum. See FIG. 1. Infrared radiation can be optically focused and directed by lenses or mirrors, or dispersed by prisms. At the same time it can be transmitted like radio or radar waves through materials which are opaque to visible light. Consequently, infrared radiation exhibits some of the characteristics of both visible light and of radar and radio waves, and in certain applications has outstanding advantages over both these forms of electromagnetic radiation, thereby accounting for its widespread popularity in heat radiation applications. Four quite natural, though purely arbitrary divisions of the infrared spectrum are commonly used. These are: (i) the "near-infrared" region from approximately 0.7 microns to 3 microns; (ii) the "middle-infrared" region from approximately 3 to 6 microns; (iii) the "far-infrared" region from approximately 6 to 15 microns; and (iv) the "extreme-infrared" region from approximately 15 to 1,000 microns.

The spectrum of every thermal source will always contain infrared radiation, and for all heater temperatures now attainable, most of the radiation actually falls in the infrared region. Thus, any modern thermal radiator is essentially an infrared source. An example of this would be a simple, closely wound spiral of nichrome wire, the wire being heated to an approximate range of 1200° to 1500° K. by passage of electric current. A disadvantage, however, of the nichrome spiral is that optical images of the source are not uniform. This disadvantage may be overcome by surrounding the coil with a uniform ceramic tube, which in turn is heated to approximately 1400° K. by the nichrome coil, an arrangement that combines the desirable properties of nichrome with the desirable optical properties of the uniform source. The ceramic sleeve over the nichrome heater is done so that a thermal mass is provided to optically diffuse the infrared radiation being emitted by the nichrome. The ceramic sleeve is absorbing the nichrome's infrared radiation and reradiating the infrared radiation in a diffuse uniform output. The infrared radiation from the ceramic sleeve is never greater than the infrared radiation from the nichrome heater and has the same spectral output as the heater. The disadvantage of this type arrangement is that the infrared radiation is not focused within any of the infrared regions. Therefore, it does not follow that every incandescent body makes a good infrared source. In the prior art there are several infrared generators which are known and which are used for radiating, concentrating, and transporting energy. Included among these are: the Nernst glower, the globar, the Welsbach mantle, and the infrared incandescent lamp.

The Nernst glower consists of a cylindrical rod or tube of refractory oxides, e.g., zirconium oxide, yttrium oxide, etc. A flexible platinum conductor is attached to each end of the rod and electrical current applied to the conductors. Since the Nernst glower's operating temperature is about 2,000° K., starting temperature is usually achieved with the aid of an auxiliary heater such as a coil of platinum wire wound on a ceramic form which is placed in close proximity to the glower and backed by a reflector. Once the glower is operating satisfactorily, the auxiliary heater is turned off. The rod reaches incandescence directly in the air and then becomes a powerful source of infrared radiation up to 14 microns with peak infrared radiation output at about 2 microns.

The globar is a rod of bonded silicon carbide capped with metallic caps which serve as electrodes for the conduction of current through the globar from a power source. The globar conducts readily at normal temperatures and so does not need to be heated on starting. The passage of current causes the globar to heat yielding radiation at a temperature above 1,000° C.

The Welsbach mantle or gas mantle consists essentially of a light cloth jacket prepared largely with thorium oxide and heated by a hot gas or oil vapor. The radiation of this source in the range from 0.7 to 8 microns is small, but it increases with wavelength, and beyond.

The Nernst glower emits the most energy per unit area from 2 to 14 microns. The mantle surpasses the Nernst glower at 14 microns and the globar surpasses the Nernst glower at 15.5 microns. The mantle is superior to both the globar and Nernst glower from 14 to 25 microns. Beyond 25 microns the Nernst glower is approximately equivalent to a 900° C. blackbody, and the globar and mantle are 1.4 times better than the Nernst glower at these longer wavelengths.

Incandescent lamps with carbon, tungsten, and other heater elements serve also as sources of infrared radiation. The tungsten filament lamps radiate 50% of their power in the wavelength range from 0.75 to 1.4 microns, and 33% in the wavelength range beyond 1.4 microns. The carbon filament lamps radiate primarily in the spectral region from 1.5 to 2.5 microns. For equal temperatures, the relative total power in the infrared spectral region is higher for the carbon filament than for the tungsten filament lamps. However, bulbs of the carbon lamps tend to blacken because of intensive sputtering of the filaments.

The above described enfrared generators emit infrared radiation maximums corresponding to black body radiation, and emit primarily in the near, middle and far infrared regions. Emissions above 40 microns are limited.

SUMMARY OF THE INVENTION

The present invention is an infrared generator designed to emit infrared radiation primarily in the extreme infrared region, i.e., to 125 microns. An electrical heating element that is able to withstand very high, continuous-use temperatures is selected. The heating element is then surrounded with a non-conductive material containing dopants of rare earth oxides. Power is applied to the heating element and, as the surrounding material is heated to temperatures of 800° C. and above, substantial electromagnetic emission from the material takes place. Substantially greater infrared radiation outputs from the surrounding material than is being emitted from the heating element. Depending upon the dopant mix within the material infrared emissions from 0.7 to 125 microns are readily obtainable. The material may be so shaped about the heating element that the emissions may be focused and/or directed in a desired manner.

Electrically and mechanically the present invention is substantially different from the Nernst glower, globar, mantle, and incandescent lamps. The emitting material of the present invention is not physically connected to the power circuit as are the emitting elements of the traditional infrared generators. There is a mechanical similarity with the nichrome heater and ceramic sleeve assembly described above in that the present invention can be configured so that a ceramic-like sleeve surrounds the heater. However, the ceramic sleeve about the nichrome heater, when heated, radiates as a black body at the same frequency and energy as the heater. The placing of an optical diffuser over emitting sources is common knowledge, and is used in many forms of lighting and heating systems. The sleeve of the present invention, however, is the infrared generator, with diffusion a secondary, even accidental, effect. The sleeve of the present invention is excited to higher levels of infrared output than the heater, because of an induced shift in frequency due to the unique ceramic materials used. Experimental results demonstrating this frequency shift will be discussed in more detail below.

In another embodiment of the invention, a tube of nonconductive material containing dopants of rare earth oxides is surrounded by an electrical heating element that is able to withstand very high, continuous-use temperatures. Substantially greater infrared radiation outputs from the tube than from the heater element. The semiconductor industry frequently uses mulite ($Al_2O_3$) liners inside wound heating elements to diffuse the infrared radiation and provide more uniform heating, but none of these liners exhibit any shift in level of infrared radiation or frequency of infrared radiation as does the present invention.

DETAILED DESCRIPTION OF THE INVENTION

Figure 1:
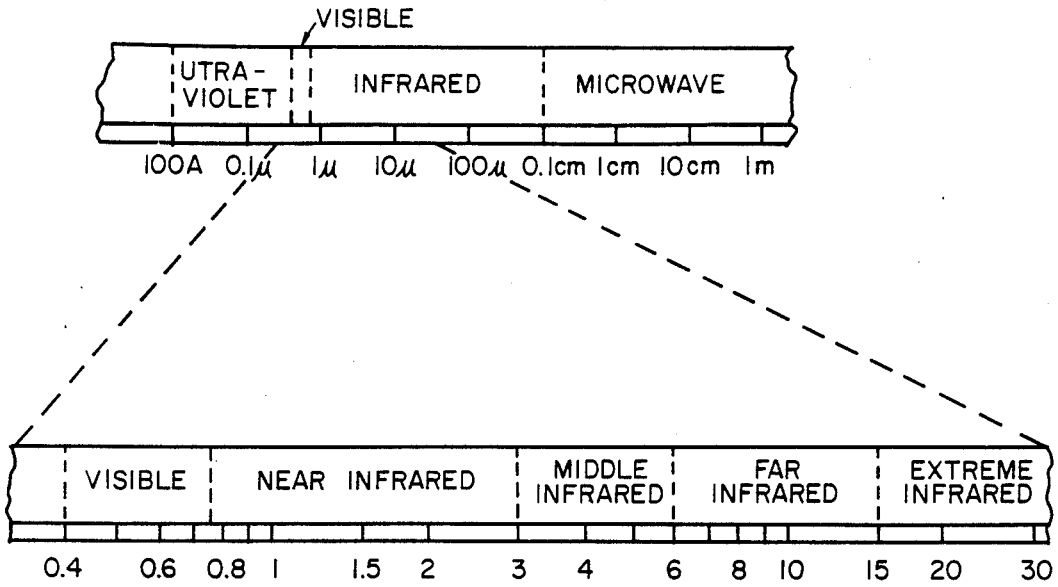
FIG. 1 is a graphical representation of that portion of the electromagnetic spectrum in which the infrared radiation band is found.
Figure 2:
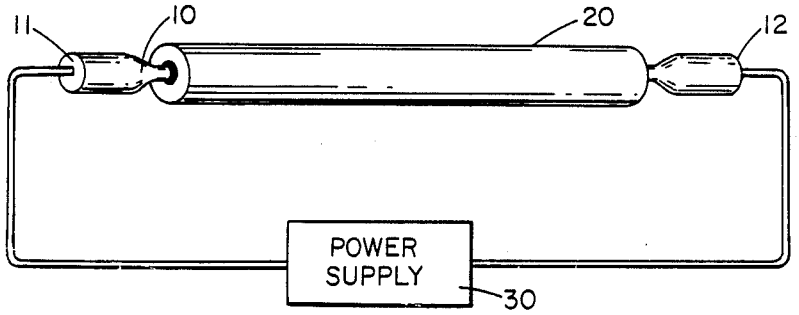
FIG. 2 is a schematic representation of one embodiment of the present invention.
Figure 3:
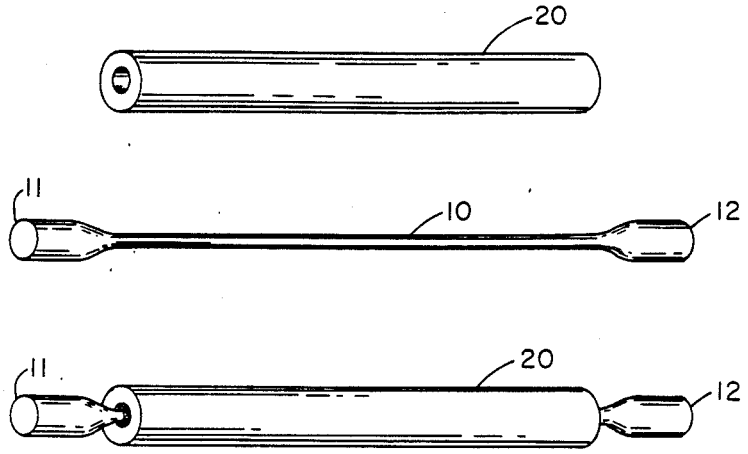
FIG. 3 is a schematic representation of the invention of FIG. 2 disassembled.
Figure 4:
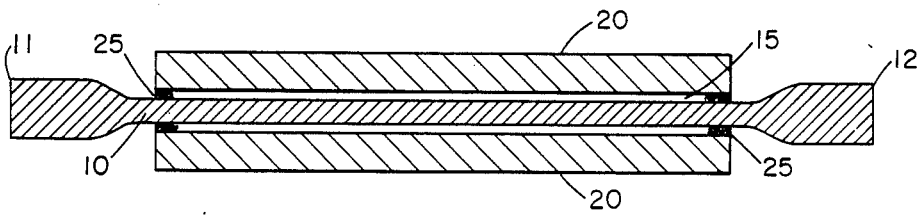
FIG. 4 is a cross-sectional view of the invention of FIG. 2.

Referring more particularly to the drawings wherein like numerals indicate like elements, FIGS. 2 and 3 illustrate one embodiment of the infrared generator of the present invention. There is shown an electrical heating element 10 concentrically placed within a ceramic-like sleeve 20. The heating element 10 has two, aluminized terminal ends 11 and 12 across which a power supply 30 is attached. The heating element 10 must be able to withstand very high, continuous-use temperatures. A heater material such as one of the Kanthal Super products or equivalent would be appropriate. The Kanthal Super heating element products withstand temperatures up to 1,700° C. and consist of a "cermet" material comprised principally of molybdenum disilicide ($MoSi_2$) and ceramic binders. The heater 10 may be straight or U-shaped. As may be more clearly seen in FIG. 4, the sleeve 20 does not touch the heater 10. There is an airspace 15 between the heater 10 and sleeve 20. To reduce the chimney effect which may be caused by this arrangement, the airspace 15 near the ends 21 of the sleeve 20 may be packed with a quartz wool 25 or other high temperature insulating material.

The sleeve 20 is made of a non-conductive material that can be excited into emissions in the infrared spectrum. Materials which may be used include thoria ($ThO_2$), yttria, niobium oxide, zirconia ($ZrO_2$), hafnia ($HfO_2$), and mixtures thereof, along with dopants of rare earths. When this material is heated to temperatures of 800° C. or greater, emissions in the wavelength range from 0.5 microns to microwaves may be obtained. The addition of cerium dioxide in concentrations of one to five percent will enhance emissions in the one to 2 micron range. Different mixtures of refractory and rare earth oxides may be used. Since the material of the sleeve 20 can be varied in composition, the frequency range of output can be controlled and tailored to a specific application. Also, since electrical heating elements capable of withstanding very high temperatures are now available, a practical refractory metal oxide - rare earth oxide doped infrared generator can be fabricated.

Figure 5:
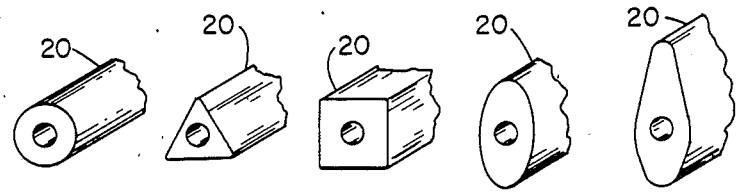
FIG. 5 illustrates in perspective various radial cross-sectional shapes that the sleeve might take.

This particular embodiment of the invention uses zirconia ($ZrO_2$) fully stabilized with yttria. Hafnia or thoria may also be used in place of zirconia. A typical sleeve composition might be zirconia 90% and yttria 10%. Many mixtures of refractory and rare earth oxides could be used to gain energy output in a specific frequency range. However, the preferred embodiments would have at least 80% zirconia. The surface shape of the sleeve 20 can be used to focus infrared radiation. FIG. 5 illustrates some shapes which may be used to direct and control infrared radiation output.

Figure 6:
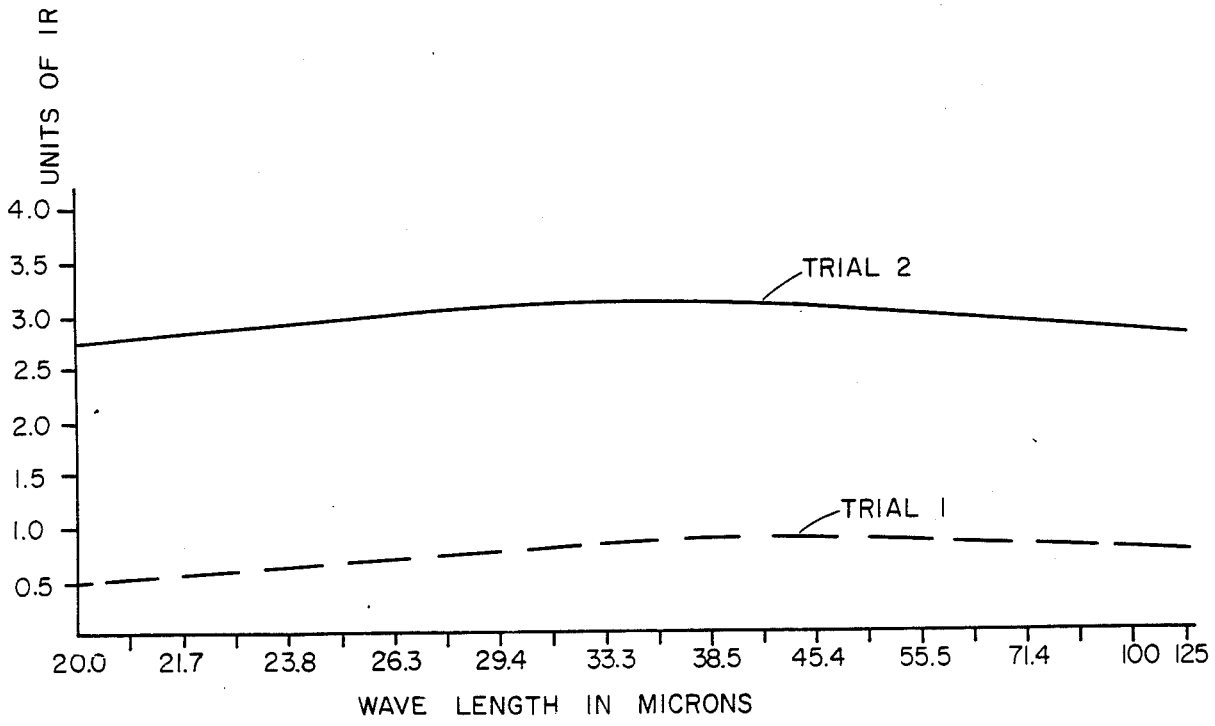
FIG. 6 graphically represents the outputs from the invention with and without the sleeve.

In laboratory tests readings were taken with and without the present invention's ceramic sleeve 20. FIG. 6 illustrates the comparative infrared emissions of both configurations. The horizontal axis shows spectral output in microns, ranging from 20 to 125 microns. The vertical axis shows comparative units of infrared radiation, ranging from 0 to 5 units. Trial 1 measured the infrared radiation emitted from a Kanthal Super heater 10 consisting of a cermet material comprised principally of molybdenum disilicide. Electric current applied to the heater was 12.6 amps. At 20 microns there were b 0.5 units of infrared radiation. At 38.5 microns, there were 1.0 units, and at 125 microns, there were 0.75 units of infrared radiation. If a diffusion sleeve, as was discussed previously, was placed over the heater 10, the measurements would have been the same or slightly less. In Trial 2, a ceramic sleeve 20 comprised of 90% zirconia and 10% yttria was concentrically placed about the heater 10, similar to the configuration illustrated in FIG. 2. An electric current of 12.6 amps was again applied to the heater 10. At 20 microns, 2.875 units of infrared radiation were measured. At 38.5 microns, there were 4.05 units, and at 125 microns, there were 2.875 units. The increase in infrared radiation from the invention's sleeve 20 ranged from 5.75 to 3.83 times the normal infrared radiation emitting from the heater 10 alone.

Figure 7:
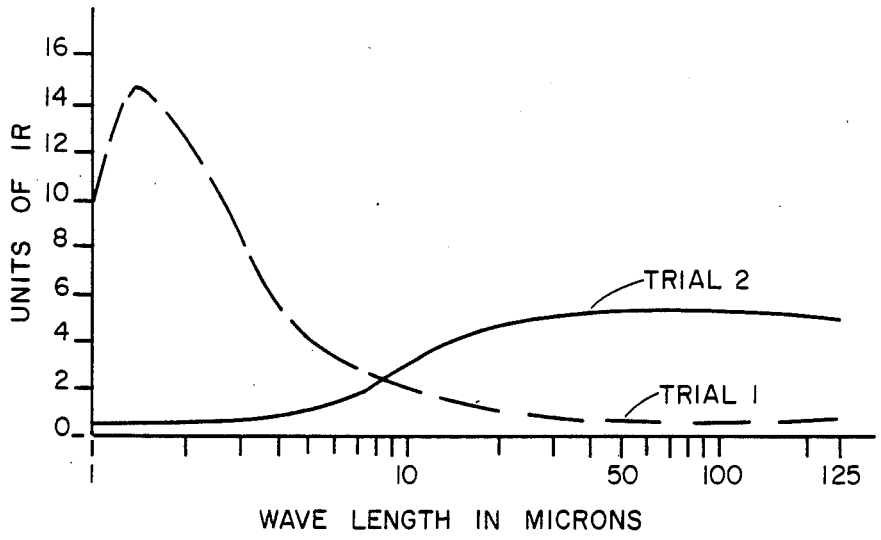
FIG. 7 graphically represents the induced frequency shift of the present invention.

FIG. 7 graphically illustrates the spectral shift in energy output caused by the present invention. The vertical axis represents comparative units of infrared radiation, and the horizontal axis shows spectral output in microns on a logarithmic scale. The broken line shows the radiation spectra of a blackbody at approximately 1400° C., corresponding to the powered Kanthal heating element 10 in Trial 1, and the solid line corresponds to the infrared generator which is this same powered element 10 surrounded by the rare-earth/refractory metal oxide-doped sleeve 20 in Trial 2. The blackbody has a sharp emissions maximum between one and two microns wavelength, falling off quickly towards the shorter wavelengths, and asymptotically towards the longer wavelengths. Although not shown on this graph (which extends down to one micron only), there is also some visible light output which is evidenced by the fact that the Kanthal heating element 10 glows reddish-orange when powered. By conservation of energy, the total energy output over the entire spectrum cannot be altered by adding the sleeve 20. What the sleeve 20 does is to absorb the visible and near infrared output of the heating element 10 and re-emit this energy in a broad band of much longer wavelength infrared. Thus, the sleeve 20 does not glow when the infrared generator is powered, and has relatively low emissions below twenty microns. However, the sleeve 20 output between twenty and one hundred twenty-five microns is several times that of a comparably powered blackbody source, the result of converting photons of lower wavelengths into photons in the 20–125 micron range. In summary, when electric current was applied to the heater 10 alone in Trial 1, the heater 10 visibly glowed. The heater 10 was in effect acting as a classical blackbody radiator with a strong radiation output in the visible and near infrared spectrums. The broken line in FIG. 7 portrays this. When electric current was applied to the heater 10 enveloped by the ceramic sleeve 20 in Trial 2, the sleeve did not glow. The energy emitted by the heater 10 acting as a blackbody radiator was shifted by the sleeve 20 to the far and extreme infrared spectral range.

Figure 8:
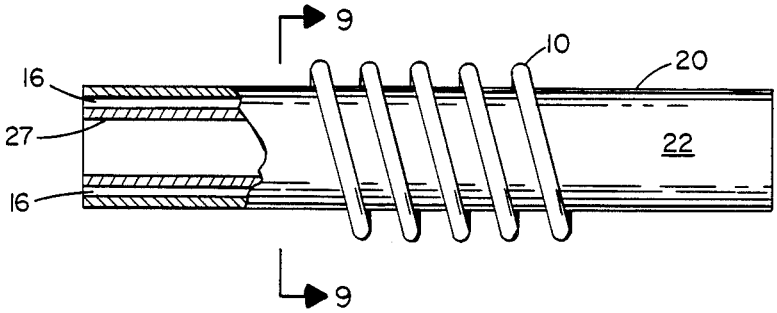
FIG. 8 is a schematic representation of another embodiment of the invention.
Figure 9:
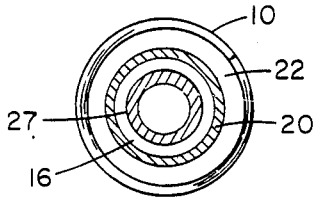
FIG. 9 is a cross-sectional view along the line 9—9 of FIG. 8.

FIGS. 8 and 9 illustrate another embodiment of the invention. In this embodiment a doped zirconia tube 20 has a heating element 10 spirally wound about its external surface 22. A quartz liner 27 is concentrically placed within the tube 20. The space 16 between the tube 20 and liner 27 is filled with air or an inert gas. The zirconia tube 20 would act as a generator of infrared energy when excited into emission by the heating of the high temperature winding 10. The work to be done would be placed in the quartz liner 27 inside of the zirconia tube 20.

It is understood that the above described embodiments are merely illustrative of the application. Other embodiments may be readily devised by those skilled in the art which will embody the principles of the invention and fall within the spirit and scope thereof.

We claim:

1. A long-wave infrared generator comprising:

a blackbody, near-infrared generating heater element;

a power source directly connected to said heater element; and a sleeve of stabilized, non-conductive material containing one or more dioxides selected from a group consisting of zirconium, hafnium and thorium, and one or more stabilizing sesquioxides selected from a group consisting of scandium, yttrium and lanthanum, wherein said sleeve surrounds said heater element about its radial axis.

2. An infrared generator as recited in claim 1 wherein:

said sleeve absorbs the heater element's near-infrared radiation output, converts and re-radiates said heater element radiation output as non-blackbody, long-wave infrared radiation.

3. The infrared generator as recited in claim 2, wherein:

the heater element is made of materials able to withstand very high, continuous-use temperatures.

4. The infrared generator as recited in claim 3, wherein:

the heater element heats said sleeve to a temperature greater than 800° C.

5. The infrared generator as recited in claim 4, wherein:

the sleeve is so positioned about the heater element that it does not touch said heater but forms an air space between heater and sleeve.

6. The infrared generator as recited in claim 5, wherein:

the air space near the ends of the sleeve are packed with a material selected from a group consisting of quartz wool, high temperature insulating material, and mixtures.

7. The infrared generator as recited in claim 6, wherein:

the heater element is concentrically positioned within said sleeve.

8. An infrared generator as recited in claim 7 wherein:

said stabilizing group includes cerium dioxide and sesquioxides from the remainder of the lanthanides.

9. The infrared generator as recited in claim 8, wherein:

said sleeve has a circular radial cross-section.

10. The infrared generator as recited in claim 8, wherein:

said sleeve has a triangularly-shaped radial cross-section.

11. The infrared generator as recited in claim 8, wherein: said sleeve has a square radial cross-section.

12. The infrared generator as recited in claim 8, wherein:

said sleeve has an elliptically-shaped radial cross-section.

13. The infrared generator as recited in claim 8, wherein:

said sleeve has a hyperbolically-shaped radial cross-section.

14. The infrared generator as recited in claim 8, wherein:

said sleeve has an asymmetrically-shaped radial cross-section.

15. A long-wave infrared generator comprising:

a tube of stabilized non-conductive material containing one or more dioxides selected from a group consisting of zirconium, hafnium and thorium, and one or more stabilizing sesquioxides selected from a group consisting of scandium, yttrium and lanthanum;

a heater element surrounding said tube; and a power source directly connected to said heater element.

16. An infrared generator as recited in claim 15 wherein:

said tube absorbs the heater element's near-infrared radiation output, converts and re-radiates said heater element radiation output as non-blackbody, long-wave infrared radiation.

17. The infrared generator as recited in claim 16, wherein:

the heater element is made of materials able to withstand very high, continuous-use temperatures.

18. The infrared generator as recited in claim 17, wherein:

the heater element heats said sleeve to a temperature greater than 800° C.

19. The infrared generator as recited in claim 18, wherein:

the heater element is so positioned about the sleeve that it does not touch said sleeve.

20. The infrared generator as recited in claim 19, wherein:

said heater element is spirally wound about said sleeve.

21. The infrared generator as recited in claim 20, further comprising:

a quartz liner concentrically positioned within said sleeve.

22. The infrared generator as recited in claim 21, wherein:

said quartz liner and said sleeve have a space between themselves.

23. The infrared generator as recited in claim 22, wherein:

said space is filled with an inert gas.

24. An infrared generator as recited in claim 23 wherein:

said stabilizing group includes cerium dioxide and sesquioxides from the remainder of the lanthanides.

* * * * *